US007829806B2

(12) United States Patent
Garvey

(10) Patent No.: US 7,829,806 B2
(45) Date of Patent: Nov. 9, 2010

(54) FLOWSWITCH HAVING O-RING PAIRS ARRANGED IN CORRESPONDING PAIRS OF O-RING GROOVES SEPARATED BY RESPECTIVE FLANGES OF A PIVOT ROD

(75) Inventor: John C. Garvey, Chicago, IL (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 545 days.

(21) Appl. No.: 11/788,776

(22) Filed: Apr. 20, 2007

(65) Prior Publication Data

US 2008/0258088 A1 Oct. 23, 2008

(51) Int. Cl.
*H01H 35/06* (2006.01)

(52) U.S. Cl. ..... 200/81.9 R

(58) Field of Classification Search ..... 200/81.9 R; 73/861.74–861.76

See application file for complete search history.

(56) References Cited

U.S. PATENT DOCUMENTS 2,203,331 A 4/1940 Hinsch
3,065,316 A 11/1962 Olson
3,188,421 A * 6/1965 Rowell ..... 200/81.9 R
3,452,169 A 6/1969 Ruxton
3,501,605 A 3/1970 Hutchinson et al.
4,110,575 A 8/1978 Meisenheimer, Jr.
4,926,903 A 5/1990 Kawai
4,955,785 A 9/1990 Cohen

OTHER PUBLICATIONS

International Search Report dated Aug. 14, 2008 (3 pages).

* cited by examiner

*Primary Examiner*—Ross N Gushi

(57) ABSTRACT

The present invention provides a flowswitch for installing in piping, featuring a flowswitch base having an inner cavity; a pivot rod being arranged for rotating in the flowswitch base, the pivot rod having a pair of O-ring grooves; a paddle arm being coupled to the pivot rod inside the cavity, for moving in response to fluid flowing in the piping and rotating the pivot arm; lubricating O-rings being installed onto the pivot rod with each O-ring arranged in a respective O-ring groove for providing a respective seal between fluid being sensed and the outside environment and acting as a bearing on which the pivot rod rotates when the paddle arm moves, the grooves acting to holding the O-rings in place on the pivot arm in response to pressurized fluid flowing in the piping; and an actuating arm being coupled between the pivot arm and the pivot rod for actuating a switch when the pivot arm rotates.

7 Claims, 6 Drawing Sheets

Flowswitch Having Bellows Design

Flowswitch Having O-Ring Design

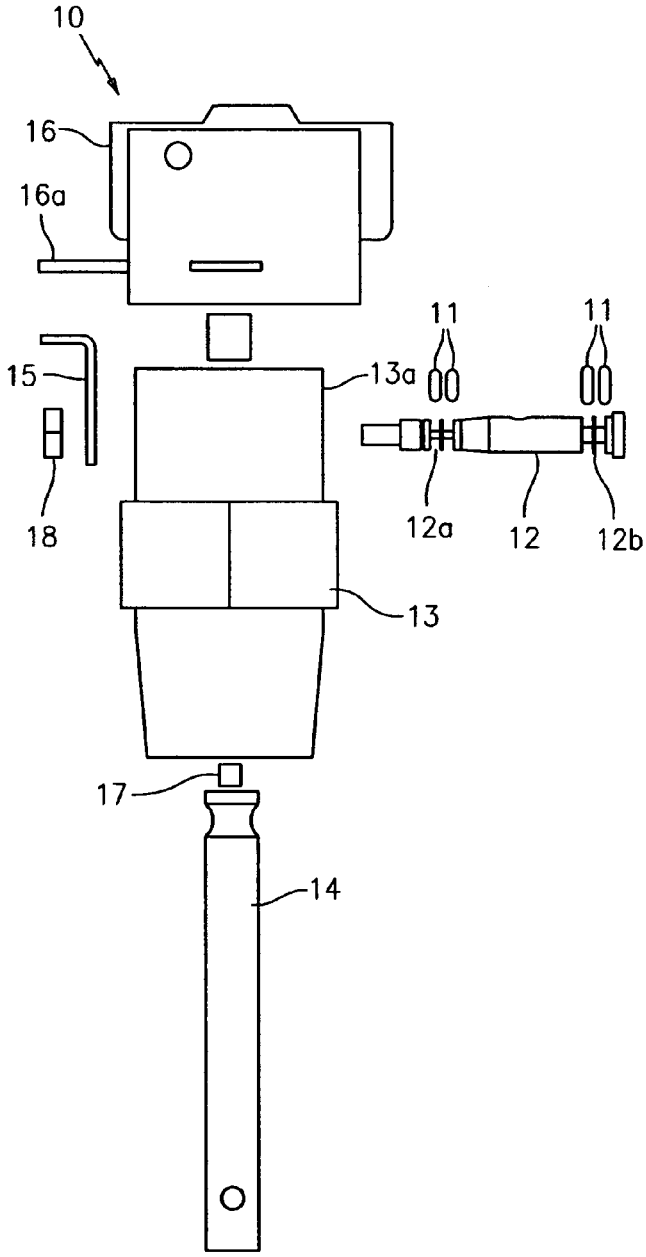
FIG. 3a: Exploded View
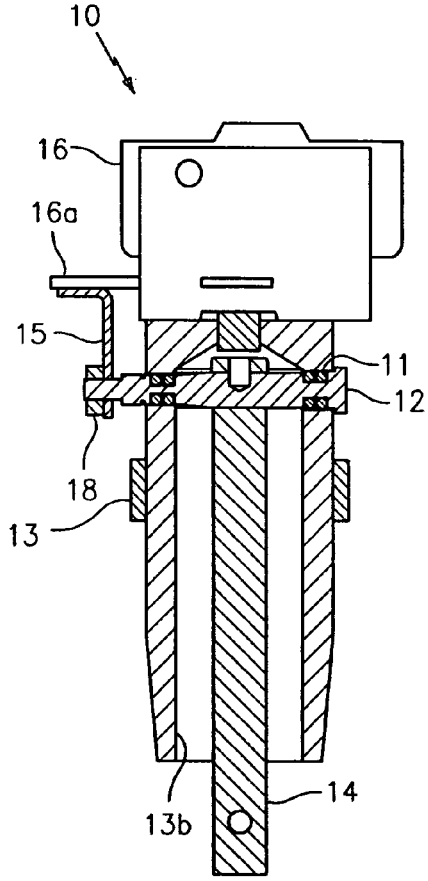
FIG. 3b: Cutaway View
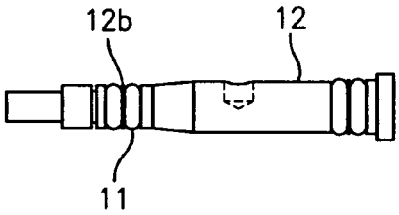
FIG. 3c
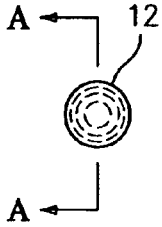
FIG. 3d
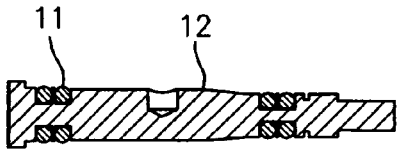
FIG. 3e: SECTION A–A FIG. 3h: SECTION AA-AA

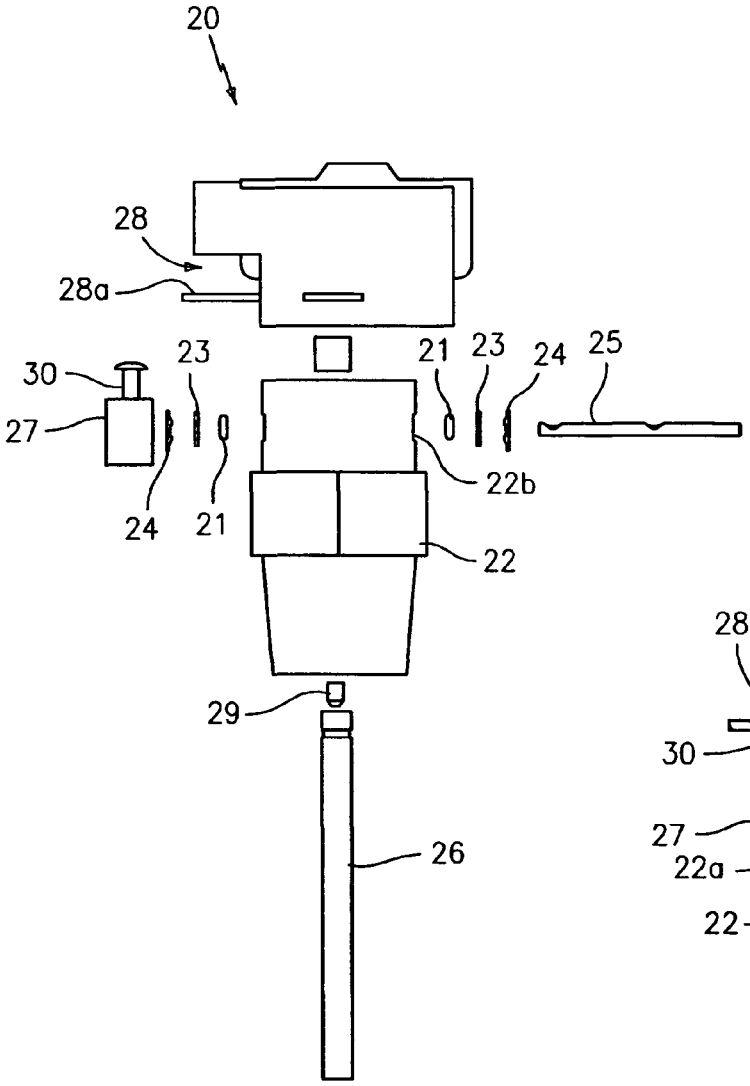
*FIG. 4a*: Exploded View
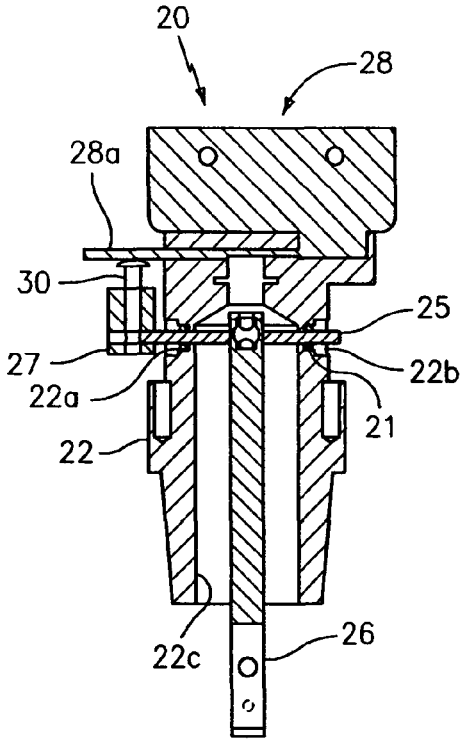
*FIG. 4b*: Cutaway View

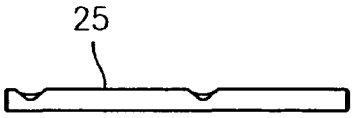
FIG. 4c
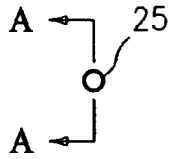
FIG. 4d
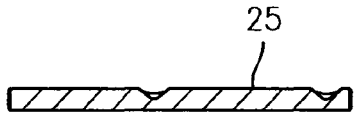
FIG. 4e: SECTION A–A
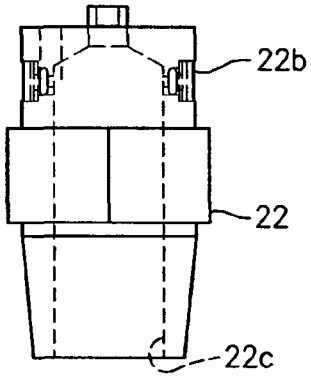
FIG. 4f
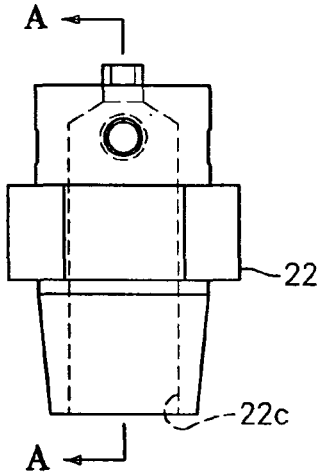
FIG. 4g
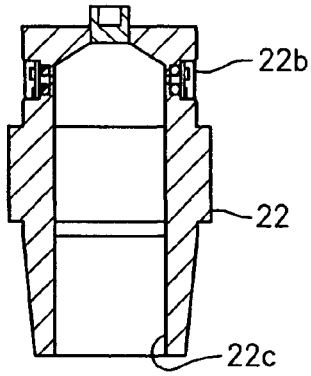
FIG. 4h: SECTION A–A
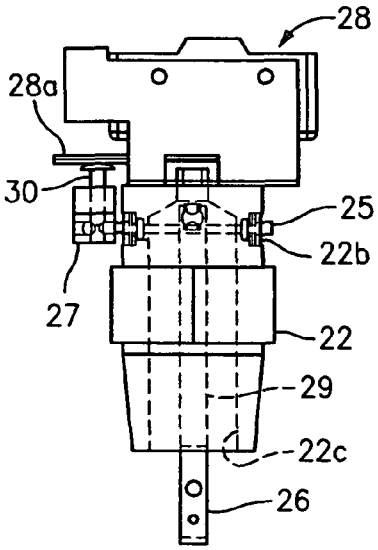
FIG. 4i
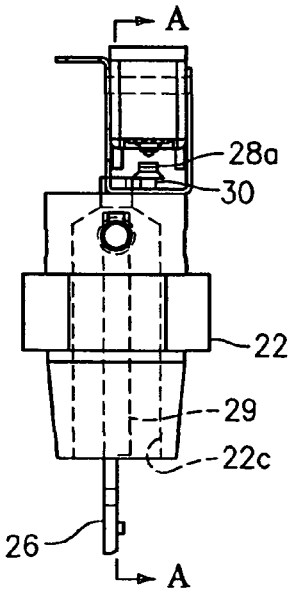
FIG. 4j
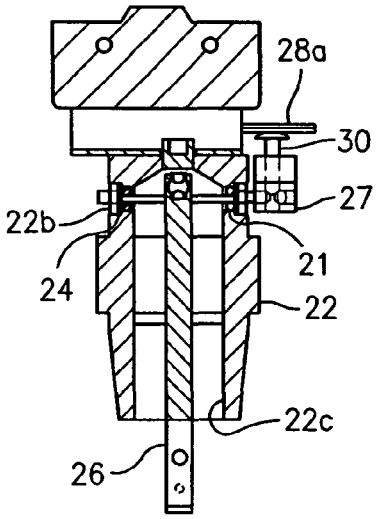
FIG. 4k: SECTION A–A

FLOWSWITCH HAVING O-RING PAIRS ARRANGED IN CORRESPONDING PAIRS OF O-RING GROOVES SEPARATED BY RESPECTIVE FLANGES OF A PIVOT ROD

BACKGROUND OF THE INVENTION

1. Field of the Invention

The present invention relates to a flowswitch; and more particularly to a flowswitch used to monitor and detect the flow or no flow condition of liquids in pipelines.

2. Brief Description of Related Art

Flowswitches are used to monitor and detect the flow or no-flow condition of liquids in pipelines. A flowswitch can make or break an electrical signal when flow or no-flow is detected and is used to actuate a signal when flow stops, start a motor with flow, shut off an alarm when flow is adequate, or stop a motor with no flow. A flowswitch typically has a wetted side that installs into the piping that carries the liquid that will actuate the switch, and a dry side with the electrical connections.

One known flowswitch is shown in FIG. 1 and has a bellows design that has been in the field for over 20 years and customers are familiar with the design. However, disadvantages of this design include the following:

Inconsistent switching points from unit to unit;

Relatively high operating forces required to switch the unit at a minimum setting;

Switching points change as the operating pressure changes;

The bellows may erode from the cleaning solution residue left after the forming and cleaning operations;

The bellows must be soldered to flanges, and solder may contain lead;

The bellows may fail due to metal fatigue as it flexes back and forth; and

Paddle arm may not be aligned with center of base due to bellows deformation.

Moreover, a prior art search was conducted and many different valve devices were found, including the following:

One valve device is actuated by fluid flow having a shaft with an O-ring seal arranged in a housing of the valve. The other end of the shaft is arranged in a recess having no exposure to the outside environment. The shaft has a flat portion for cooperating with a switch button of a switch in a cam-like manner. However, the valve device design has an unbalanced device since the shaft only has an O-ring on one end, and the cam-like relationship between the flat portion and the bottom is likely to contribute to increased friction, especially as the valve device wears.

One fluid flow sensing device has a pair of O-rings arranged in relation to a shaft. However, the O-rings are not arranged in O-ring grooves; therefore, need washers and nuts to holding them in place on the pivot arm in response to pressurized fluid flowing in the piping.

One flow switch has side walls with a shaft passing through and connected to a paddle. The shaft is not coupled to the side walls on either side with an O-ring. The switch is actuated via a magnet and magnetic coupling.

One fluid flow sensing device has walls with a shaft passing through and connected to a vane. The shaft has O-rings and washers that are sufficiently tight to make a fluid-tight seal. The shaft also has a spring washer and nut.

One fluid measuring device has a shaft passing through a central body. The shaft has suitable packing, sleeves and nuts. However, the shaft does not have O-ring grooves for retaining the suitable packing or sleeves.

One fluid responsive switch has a transverse pin arranged in a central frame structure and has a disc coupled thereto via an arm. The pin has an annular resilient material but does not have O-ring grooves.

One spool deflection indicator does not have a shaft with a pendulant paddle for sensing fluid flow that has O-ring grooves for receiving O-rings.

One butterfly valve has a shaft with shaft bearings. Although the main body has grooves not labeled for receiving the bearings, the shaft does not have the same.

One fluid responsive switch pivot arm seal has a pivot arm arranged on a pivot pin with circumferential grooves for receiving an elastomeric material for providing additional bonding between the resilient seal. The pivot arm does not have grooves for receiving the bearings.

SUMMARY OF THE INVENTION

In its broadest sense, the present invention features a new and unique flowswitch for installing in piping, having a flowswitch base with an inner cavity; a pivot rod being arranged for rotating in the flowswitch base; a paddle arm being coupled to the pivot rod inside the inner cavity, for moving in response to fluid flowing in the piping and rotating the pivot rod; an actuating arm being coupled to the pivot rod for actuating a switch when the pivot rod rotates; and lubricating O-rings being arranged in relation to the pivot rod for providing a respective seal between fluid being sensed and the outside environment and acting as a bearing on which the pivot rod rotates when the paddle arm moves.

In one embodiment, the pivot rod has a pair of O-ring grooves, the lubricating O-rings are installed onto the pivot rod with each O-ring arranged in a respective O-ring groove, and the O-ring grooves acting to hold the O-rings in place on the pivot rod in response to pressurized fluid flowing in the piping.

In an alternative embodiment, the flowswitch base has a pair of O-ring recesses, each lubricating O-ring being arranged in a respective o-ring recess, the flowswitch having mechanical devices to hold the O-rings in place in response to pressurized fluid flowing in the piping.

The actuating arm may be rigidly coupled to the pivot rod.

The rotation of the pivot rod translates through the actuating arm into a linear position which actuates the switch.

The paddle arm may be rigidly attached to the pivot rod.

The switch may be a snap switch that can make or break and electrical signal when flow or no-flow is detected.

The pivot rod slides through openings in the wall of the flowswitch base, has an enlarged portion on one end for securing the paddle arm, and has a second portion on the other end for receiving the actuating arm.

The invention may also include steps for making the flowswitch consistent with that described above. The ease of manufacture of the flowswitch is an important aspect of the overall invention.

Advantages of the O-Ring flow switch design according to the present invention include the following:

Consistent switching points from unit to unit;

A low operating force required to switch unit at minimum setting due to less friction in moving parts;

A balanced design results in negligible change in switching points due to changes in operating pressure;

No chemical cleaners required in the making of parts or assembly;

No soldering required;

All parts are environmentally friendly;

O-ring sealing mechanism will not fail due to flexing fatigue;

The paddle arm is aligned with center of base and will stay aligned;

Minimal movement of moving parts results in less mechanical wear; and

Fewer parts required for the final assembly than the bellows design flow switch.

BRIEF DESCRIPTION OF THE DRAWING

FIG. 3*a* is an exploded view of an O-ring design according to the present invention.

FIG. 3*b* is a cutaway view of the O-ring design according to one embodiment of the present invention.

FIG. 3*c* is a schematic view of a pivot rod shown in FIG. 3*a*.

FIG. 3*d* is another schematic view of a pivot rod shown in FIG. 3*a* rotated 90°.

FIG. 3*e* is a cross-sectional schematic view of the pivot rod shown in FIG. 3*d* along lines A-A.

FIG. 3*h* is a cross-sectional schematic view of the flowswitch base shown in FIG. 3*g* along lines AA-AA.

FIG. 4*a* is an exploded view of an O-ring design according to one embodiment of the present invention.

FIG. 4*b* is a cutaway view of the O-ring design according to one embodiment of the present invention.

FIG. 4*c* is a schematic view of a pivot rod shown in FIG. 4*a*.

FIG. 4*d* is another schematic view of a pivot rod shown in FIG. 4*a* rotated 90°.

FIG. 4*e* is a cross-sectional schematic view of the pivot rod shown in FIG. 4*d* along lines A-A.

FIG. 4*f* is a schematic view of a flowswitch base shown in FIG. 4*a*.

FIG. 4*g* is a schematic view of the flowswitch base shown in FIG. 4*f* rotated 90°.

FIG. 4*h* is a cross-sectional schematic view of the flowswitch base shown in FIG. 4*g* along lines A-A.

FIG. 4*i* is a schematic view of a flowswitch shown in FIG. 4*a*.

FIG. 4*j* is a schematic view of the flowswitch-shown in FIG. 4*f* rotated 90°.

FIG. 4*k* is a cross-sectional schematic view of the flowswitch shown in FIG. 4*j* along section lines A-A.

DETAILED DESCRIPTION OF THE INVENTION

Figure 1:
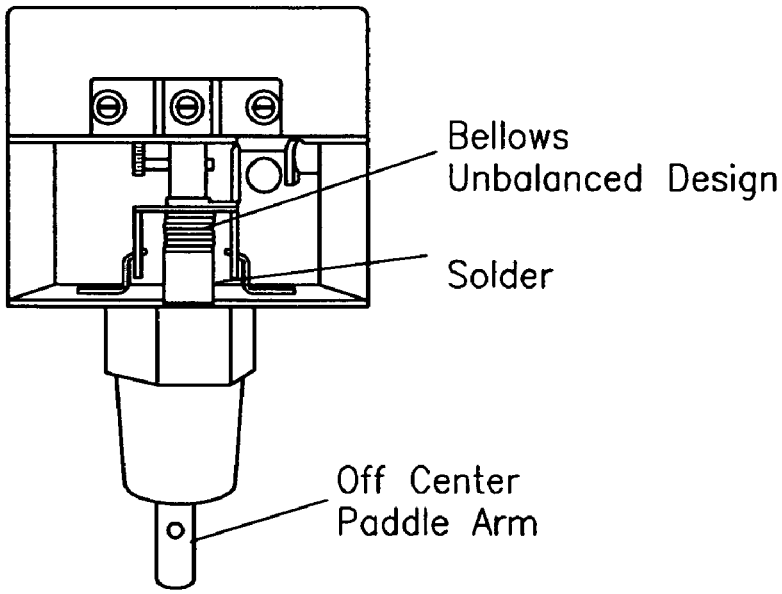
FIG. 1 (PRIOR ART)
FIG. 1 is a diagram of a flowswitch having a bellows design that is known in the art.
Figure 2:
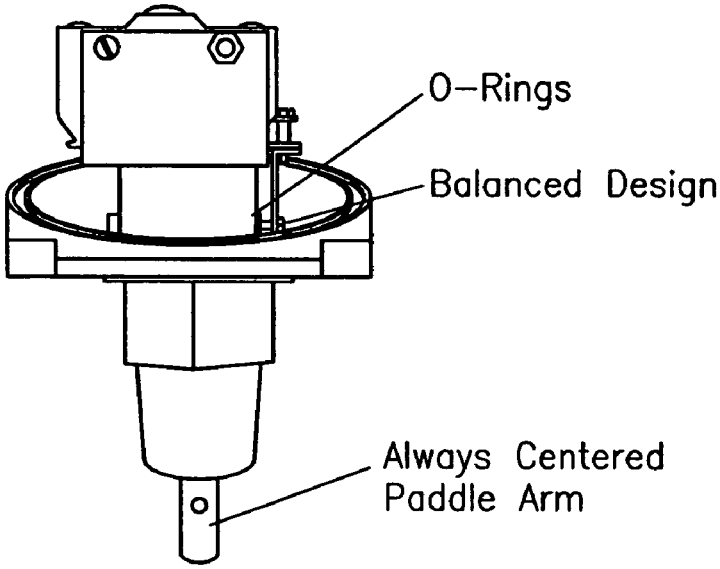
FIG. 2 is a diagram of an O-ring design according to the present invention.
Figure 3F:
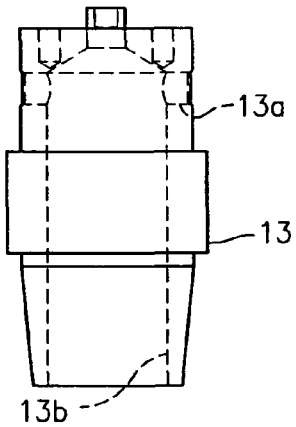
FIG. 3*f* is a schematic view of a flowswitch base shown in FIG. 3*a*.
Figure 3G:
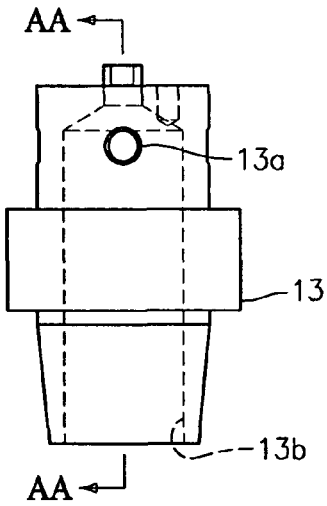
FIG. 3*g* is a schematic view of the flowswitch base shown in FIG. 3*f* rotated 90°.
Figure 3I:
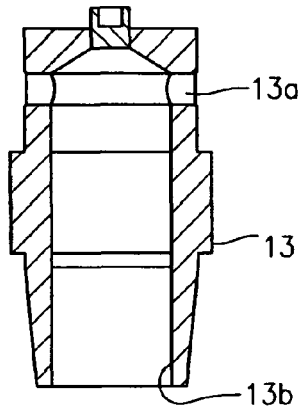
FIG. 3*i* is a schematic view of a flowswitch shown in FIG. 3*a*.
Figure 3I:
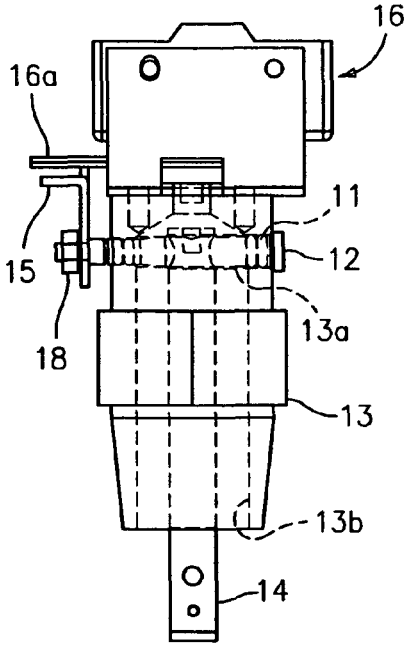
Figure 3J:
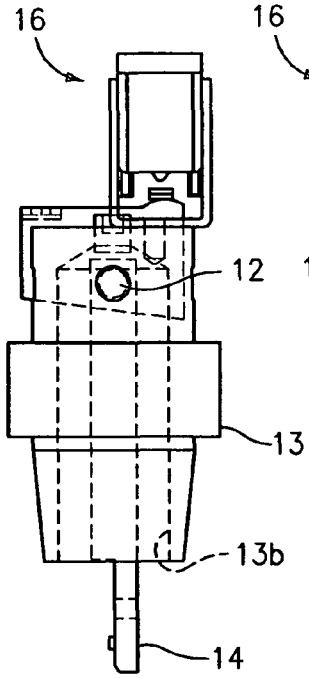
FIG. 3*j* is a schematic view of the flowswitch shown in FIG. 3*i* rotated 90°.
Figure 3K:
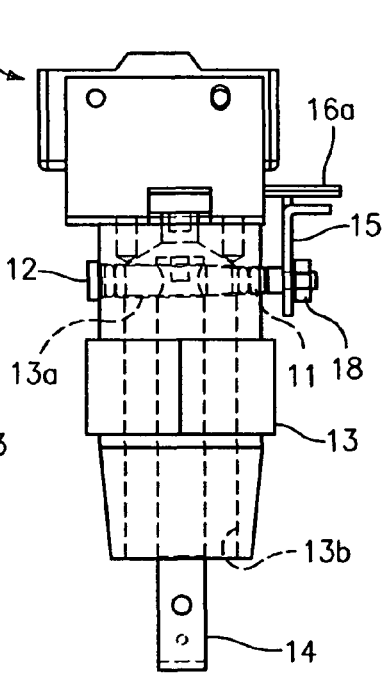
FIG. 3*k* is a schematic view of the flowswitch shown in FIG. 3*i* rotated 180°.

FIGS. 2-3*k* show an O-ring flowswitch generally indicated as 10 according to the present invention, featuring by way of example four lubricated O-rings 11 installed onto a pivot rod 12 with machined or formed o-ring grooves 12*a* and machined or formed flanges 12*b* that separate the O-rings 11. As shown, two o-rings are installed on each side of the pivot rod 12.

The pivot rod 12 is passed through an aperture 13*a* in a flowswitch base 13 and a paddle arm 14 that is arranged in the middle of an aperture 13*b* in the flowswitch base 13. The pivot rod 12 and aperture 13*a* are suitably dimensioned so that the o-rings 11 provide a seal between the fluid being sensed and the outside environment. The pivot rod 12 and aperture 13*a* are also suitably dimensioned so that the o-rings 11 also act as a bearing on which the pivot rod 12 rotates when the paddle arm 14 moves as fluid is flowing past the flowswitch 10. The scope of the invention is not intended to be limited to any such dimensioning to achieve the aforementioned functionality.

In operation, as the pivot rod 12 rotates, this motion is translated through an actuating arm 15 into a linear position which then actuates a snap switch generally indicated as 16.

The paddle arm 14 is rigidly attached by a suitable mechanical means or device 17 to the pivot rod 12; the actuating arm 15 is rigidly attached by a suitable mechanical means or device 18 to the pivot rod 12; and the actuating arm 15 is in contact with actuator 16*a* of the snap switch 16 by design for actuating the same. The scope of the invention is not intended to be limited to any particular type or kind of mechanical technique or way for rigidly attaching the pivot rod 12 to either the paddle arm 14 or the actuating arm 15, or contact of the actuating arm 15 to the actuator 16*a*.

Alternative Design

FIGS. 4*a*-4*k* show an alternative O-ring flowswitch generally indicated as 20 according to the present invention, where two lubricated o-rings 21 are installed into a flowswitch base 22 and held in place mechanically by elements or devices 23 and 24. By way of example, the flowswitch base 22 may have an internal recesses 22*a* for receiving the o-rings 21, and the mechanical elements 23 and 24 may include respectively a washer 23 and a suitable mechanical device 24 for holding the same in place. In particular, the suitable mechanical device 24 may slide into internal recesses 22*a* and frictionally engage the recess wall for holding the o-ring 21 and washer 22 in place. However, the scope of the invention is not intended to be limited to the manner in which the o-rings are received by the flowswitch base 22, or the manner in which the mechanical elements 23 and 24 hold the o-ring in place.

The pivot rod 25 is then assembled or passed through an aperture 22*b* in the flowswitch base 22 and the paddle arm 26 that is in the middle of an aperture 22*c* of the flowswitch base 22. The pivot rod 25, aperture 22*a* and aperture 22*b* are suitably dimensioned so that the o-rings 21 provide a seal between the fluid being sensed and the outside environment. The pivot rod 25, aperture 22*a* and aperture 22*b* are suitably dimensioned so that the o-rings 21 also act as a bearing on which the pivot rod 25 rotates when the paddle arm 26 moves as fluid is flowing past the flowswitch. Consistent with that discussed above, the scope of the invention is not intended to be limited to any such dimensioning to achieve the aforementioned functionality.

As the pivot rod 25 rotates, this motion is translated through the actuating arm 27 into a linear position which then actuates a snap switch 28. The paddle arm 26 is rigidly attached by a suitable mechanical means or device 29 to the pivot rod 25. The actuating arm 27 is in contact with actuator 28*a* of the snap switch 28 for actuating the same. The scope of the invention is not intended to be limited to any particular type or kind of mechanical technique or way for rigidly attaching the pivot rod 25 to either the paddle arm 26 or the actuating arm 27, or contact of the actuating arm 27 to the actuator 28*a*.

The O-Rings 11, 21

The scope of the invention is not intended to be limited to the number of O-rings 11, 21 installed on each side of the pivot rod 12, 25. For example, embodiments are envisioned in which a minimum of one o-ring is installed on each side of the pivot rod, as well as three, or four, or more o-rings. Moreover, o-rings such as elements 11, 21 are known in the art, and the scope of the invention is not intended to be limited to any particular cross-section, type, or kind thereof, or the materials from which such o-rings are made. Moreover still, the scope of the invention is also not intended to be limited to the use of flanges 12*b* between the o-rings 11, because embodiments are envisioned without the use of the same.

Snap Switches 16, 28

Snap switches such as elements 16, 28 are known in the art and the scope of the invention is not intended to be limited to any particular type or kind thereof. Consistent with that described herein, the actuation of such a snap switch will allow the flowswitch 10, 20 to monitor and detect the flow or no-flow condition of liquids in pipelines (See FIGS. 5*a* and 5*b*). For example, the flowswitch 10, 20 can make or break an electrical signal when flow or no-flow is detected and actuate a signal when flow stops, start a motor with flow, shut off an alarm when flow is adequate, or stop a motor with no flow. However, it is important to note that the scope of the invention is not intended to be limited to whether a flow or no flow condition is sensed, or the action being taken once such a condition is sensed.

Typical Applications of Flowswitch in Pipelines

Figure 5A:
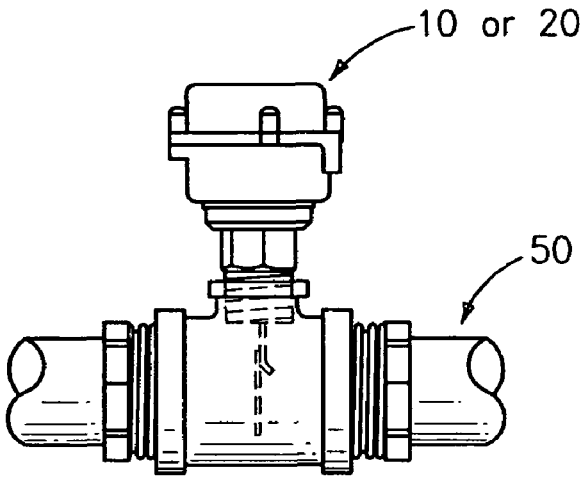
FIG. 5*a* is a view of a suggested installation of the flowswitch according to the present invention.
Figure 5B:
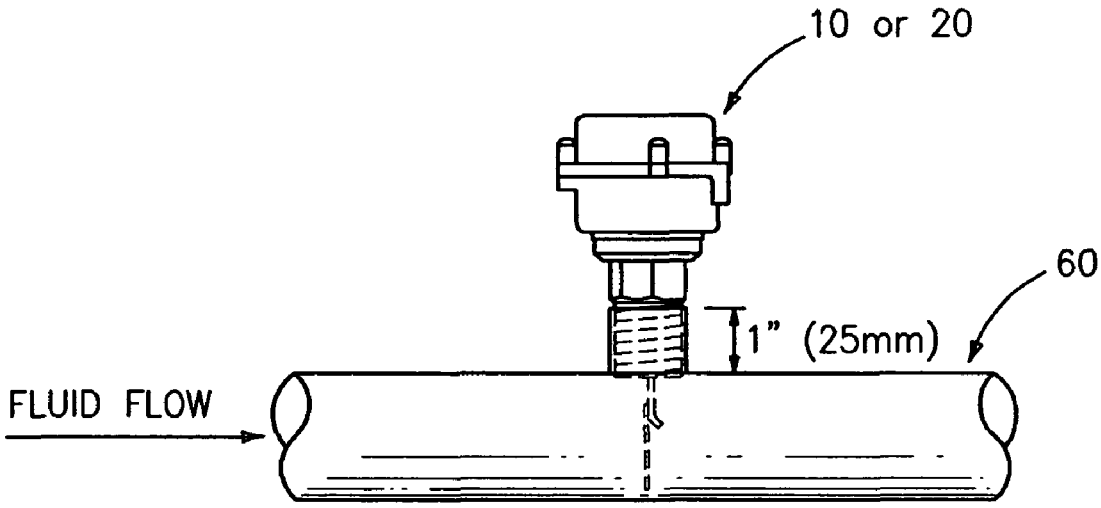
FIG. 5*b* is a view of another suggested installation of the flowswitch according to the present invention.

FIGS. 5*a* and 5*b* show typical applications of a flowswitch 10 or 20 according to the present invention in pipelines generally indicates as 50, 60.

In FIG. 5*a*, two pipes 52, 54 are coupled together by a coupler 56 and the flowswitch 10 or 20 is suitably adapted therein.

In FIG. 5*b*, one pipe 62 has the flowswitch 10 or 20 suitably adapted therein.

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

I claim:

1. A flowswitch for installing in piping, comprising:

a flowswitch base having an inner cavity;

a pivot rod being arranged for rotating in the flowswitch base, the pivot rod configured with a first pair of machined or formed O-ring grooves separated by a first machined or formed flange, and also configured with a second pair of machined or formed O-ring grooves separated by a second machined or formed flange;

a paddle arm being coupled to the pivot rod inside the inner cavity, configured for moving in response to fluid flowing in the piping and rotating the pivot rod;

an actuating arm being attached to the pivot rod and configured for actuating a switch when the pivot rod rotates; and a first pair of lubricating O-rings being respectively arranged in the first pair of machined or formed O-ring grooves and separated by the first machined or formed flange, and a second pair of lubricating O-rings being respectively arranged in the first pair of machined or formed O-ring grooves and separated by the first machined or formed flange, each of the first O-ring grooves and the first machined or formed flange acting to hold each of the first pair of lubricating O-rings in place on the pivot rod in response to pressurized fluid flowing in the piping, each of the second O-ring grooves and the second machined or formed flange also acting to hold each of the second pair of lubricating O-rings in place on the pivot rod in response to pressurized fluid flowing in the piping, so that the first pair of lubricating O-rings and the second pair of lubricating O-rings provide a respective seal between fluid being sensed and the outside environment and acting as a bearing on which the pivot rod rotates when the paddle arm moves.

2. A flowswitch according to claim 1, wherein the pivot rod is configured to slide through openings in the wall of the flowswitch base so that the first pair of lubricating O-rings and the second pair of lubricating O-rings provide a respective seal in relation to the wall of the flowswitch base.

3. A flowswitch according to claim 1, wherein the actuating arm is rigidly attached to the pivot rod.

4. A flowswitch according to claim 1, wherein the rotation of the pivot rod translates through the actuating arm into a linear position which actuates the switch.

5. A flowswitch according to claim 1, wherein the paddle arm is rigidly attached to the pivot rod.

6. A flowswitch according to claim 1, wherein the switch is a snap switch that can make or break and electrical signal when flow or no-flow is detected.

7. A flowswitch according to claim 1, wherein the pivot rod is configured to slide through openings in the wall of the flowswitch base, is configured with an enlarged portion on one end for securing the paddle arm, and is configured with a second portion on the other end for attaching the actuating arm.

* * * * *

UNITED STATES PATENT AND TRADEMARK OFFICE

CERTIFICATE OF CORRECTION

PATENT NO. : 7,829,806 B2
APPLICATION NO. : 11/788776
DATED : November 9, 2010
INVENTOR(S) : John C. Garvey It is certified that error appears in the above-identified patent and that said Letters Patent is hereby corrected as shown below:

Column 6 at line 22 (claim 1, line 19), delete “first” and insert --second--.

Signed and Sealed this
Fourth Day of December, 2012

David J. Kappos
*Director of the United States Patent and Trademark Office*